US007675407B2

(12) United States Patent
Yuk et al.

(10) Patent No.: US 7,675,407 B2
(45) Date of Patent: Mar. 9, 2010

(54) LIFE SAFETY DEVICE FOR THE HEARING IMPAIRED

(75) Inventors: Howard Yuk, East Meadow, NY (US); Javier E. Reyes, West Babylon, NY (US); Albert Lee, Brooklyn, NY (US)

(73) Assignee: Honeywell International Inc., Morristown, NJ (US)

( * ) Notice: Subject to any disclaimer, the term of this patent is extended or adjusted under 35 U.S.C. 154(b) by 370 days.

(21) Appl. No.: 11/759,800

(22) Filed: Jun. 7, 2007

(65) Prior Publication Data

US 2008/0303657 A1 Dec. 11, 2008

(51) Int. Cl.
*G08B 29/00* (2006.01)
*G08B 1/08* (2006.01)

(52) U.S. Cl. ..... 340/506; 340/539.11; 340/539.14; 340/7.6; 340/407.1; 340/825.19

(58) Field of Classification Search ..... 340/506, 340/539.11, 539.14, 7.6
See application file for complete search history.

(56) References Cited

U.S. PATENT DOCUMENTS 6,060,994 A * 5/2000 Chen ..... 340/521
6,384,724 B1 * 5/2002 Landais ..... 340/531
6,400,265 B1 6/2002 Saylor et al.
6,703,930 B2 * 3/2004 Skinner ..... 340/539.11

* cited by examiner

*Primary Examiner*—Donnie L Crosland
(74) *Attorney, Agent, or Firm*—Husch Blackwell Sanders Welsh & Katz

(57) ABSTRACT

The instant invention includes a central security and alarm system that operates to protect a home or business and includes a personal safety device to communicate with a hearing-challenged end-user at the protected home or business. The system includes at least one alarm event detection device, and a central panel in communication with the personal safety device and the at least one alarm event detection device, the central panel comprising a processor for carrying out a method of communicating to the hearing-challenged end-user at the detection of alarm events via the personal safety device. The method includes detecting an alarm event at the home or business and notifying a designated, hearing-challenged end-user that the alarm event has occurred by causing a life safety device in the possession of the hearing challenged end-user to communicate the detected event by a mechanical communication signal.

8 Claims, 2 Drawing Sheets

LIFE SAFETY DEVICE FOR THE HEARING IMPAIRED

BACKGROUND OF THE INVENTION

Figure 1:
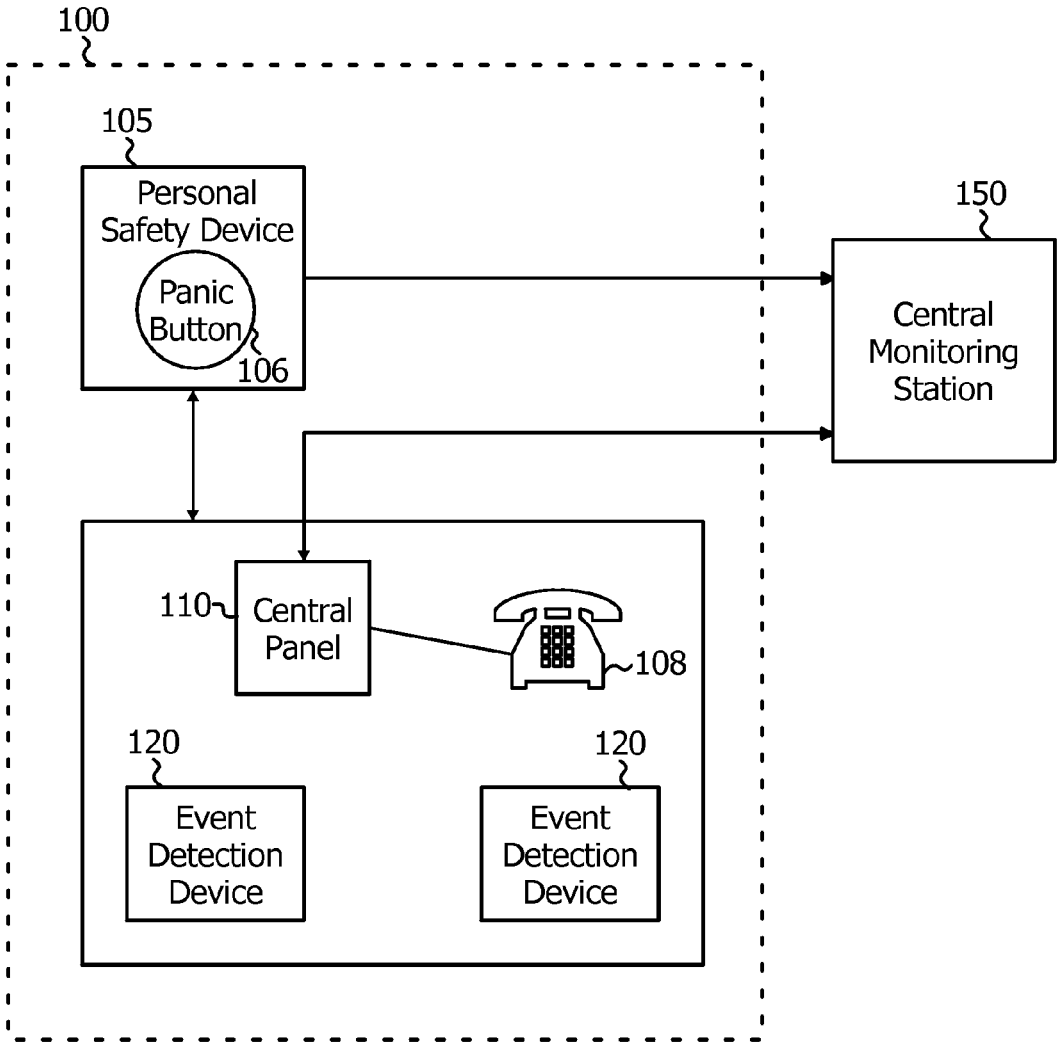

The present invention relates to security systems, and more particularly relates to a centralized security and alarm system, and related method, which operate to control a life safety device to notify a hearing-challenged end-user of a detected alarm event, or other emergent communication need, by causing the device to vibrate, or otherwise communicate the alarm event notification by non-aural means.

Home security and personal safety are major concerns for individuals, and their loved ones. Most homeowners wish to protect their valuables and maintain safe havens for themselves and their family members. To that end, numerous conventional central security and alarm systems for homes and businesses are known to provide various security system monitoring, surveillance and notification features and options to protect the homes, homeowners, family members, visitors, businesses, workers, customers, etc, and automatically notify an end-user at the protected premises at detection of an alarm event.

Conventional central security and alarm systems operate generally as follows. An alarm event detection device protecting an alarm zone, e.g., a front door, of protected premises will detect an alarm event such as an unauthorized opening of the front door. The detection is communicated by the detection device to a local central home panel, or server. The central panel, in response to receipt of detection notification, and typically after some fixed alarm-entry delay (where the alarm is not cancelled), transmits an alarm notification (signal) to the central monitoring station. Alarm event detection devices include but are not limited to window detectors, door detectors, motion sensors, digital and analog (CCTV) image or acquisition devices and cameras, passive infrared (PIR) detectors, microwave detectors, seismic detectors, dual-modality sensor, ultrasonic and other human motion detectors and systems.

The central monitoring station may attempt to contact an end user at the protected premises by calling a designated telephone or cell phone. For example, U.S. Pat. No. 6,400,265 to Saylor, et al. ("the '265 patent"), discloses a security system and method that provides for end-users to personalize alert notifications for various security devices including access to a web interfaces (e.g., personal web pages), where an end-user may monitor current security status and other information. Historical data (aggregate data from security systems), and data from other sources may be available at such a website for generating reports based on the aggregate data, and/or other sources of data. Users may register security devices and/or systems with a central security monitoring station which then accesses the user's personal preferences, profile information and/or other information used to execute alarm event notifications, investigations, reporting, etc.

Problems arise, however, when the end-user requiring notification by telephone is hearing impaired, hearing disabled, or otherwise hearing-challenged (hereinafter referred to collectively as "hearing-challenged") such as by being fast asleep or in a noisy environment at the protected premises. Hearing-challenged persons lack either full or partial ability to detect, recognize and/or understand sounds. This is problematic in that notification of an alarm event to the hearing-challenged end-user may be prevented by the end-user's inability to hear, or understand an aural signal such as a landline phone or mobile cell-phone ring-tone.

Conventional solutions for supporting the hearing-challenged by known security systems include increasing the volume of speakers or sounders, and in some cases are known to have added strobe lights as a method of notification. But when the hearing-challenged person (end-user) is completely deaf, sound asleep, or distracted by an inherently noisy environment, the conventional solutions may still fail to notify. For example, a nanny and the children under the nanny's care might be secluded in a room or entertainment suite, and could "miss" a conventional communication (by phone) to the end-user that there is a fire or security breach in some other part of the protected premises, or preventing the nanny and children from taking proper precautionary action.

Accordingly, a more efficient and effective method and device for notifying hearing-challenged end-users of detected alarm events in a way that will raise their attention is desirable. Preferably, the device communicates from the alarm system to the hearing-challenged end-user that an alarm event has occurred, and that some end-user action is necessary, where the communication is not contingent upon the hearing-challenged end-user "hearing" the alarm event signal.

SUMMARY OF THE INVENTION

To that end, the present invention solves the above problem by providing a system that operates with a life safety device preferably attached or otherwise physically contacting some portion of a hearing-challenged end-user's body and controlled to communicate a detected alarm event to the end-user through the life safety device by vibrating or by use of other non-aural communication means. The physical contact allows the life safety device to effectively notify the hearing-challenged end-user of a change in system status, and/or alarm event detections at the protected premises, indicating that action must be taken.

The action may include merely acknowledging a noticed alarm event, for example, by phoning the central station or taking some other kind of action (for example, by immediately vacating the protected premises). The life safety device preferably vibrates to communicate such notice to the hearing-challenged end-user in a manner that is similar to the manner in which a cell phone may be controlled to notice its end-user of a communication, i.e., a text message, without use of a ring tone, or other sound to notify the end-user of the call.

The personal life safety device is preferably in a form of a pendant in physical contact with the end-user's body for maintaining the close body contact required for effective communication of alarm event notification signals and other like communications. For example, the pendant comprising the life safety device, to maintain contact with the end-user body, may comprise a body necklace or belt, a bracelet, a wristband, a head band or hat, or merely a small, cell-phone like, or beeper-like electronic-based component arranged to adhere to clothing of the end-user (e.g., by Velcro). The life safety device, however, is not limited to any particular form, such as the aforementioned pendant, as long as it includes the ability to receive commands and notice the end-user in possession of the device using non-aural means.

Depending upon the status of the central security and an alarm system, the pendant or life safety device will not only vibrate to communicate to the hearing-challenged end-user, but also communicate visually to the end-user. For example, besides vibrating, the novel life safety device may control one or more LEDs included with the personal safety device to indicate that a system state change has occurred (an alarm event is a system state). It is also preferable for the vibration of the pendant or life safety device to communicate to the hearing-challenged end-user by generating a pattern of signals. For example, 3 pulses of the same short length, e.g., at 1 second for each pulse, could indicate a perimeter breach in a protected premises, and a steady (non-pulsed) vibration could indicate a need to call the central station.

In addition to these features the pendant or life safety device preferably includes standard panic buttons, which allow an end-user to activate alarms by merely depressing the panic button. Communications to the pendant need not be restricted to the RF protocol currently used in current products if they are hard-wired to or otherwise in constant communication with a control device, such as a central panel at an end-user location, e.g., to a central panel at the protected premises.

In a computer system embodiment, the invention includes a central home panel in electrical communication with the personal safety device, to at least one alarm event detection devices, and/or a central panel or central station for controlling overall system operation. The central home panel (or central station) processes alarm-event detections by capturing the alarm event and automatically controlling the pendant or life safety device to communicate the detected alarm event to the hearing-challenged end-user regardless of his/her instant hearing ability via the personal safety device.

BRIEF DESCRIPTION OF THE DRAWING FIGURES

Figure 2A:
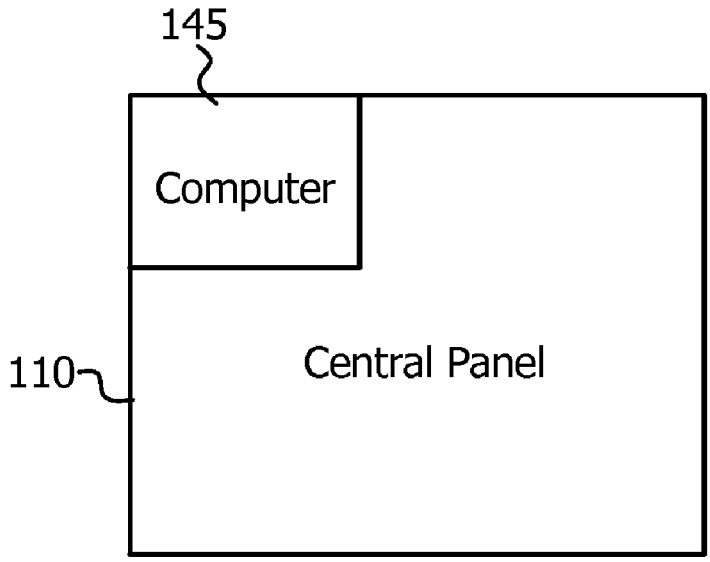
Figure 2B:
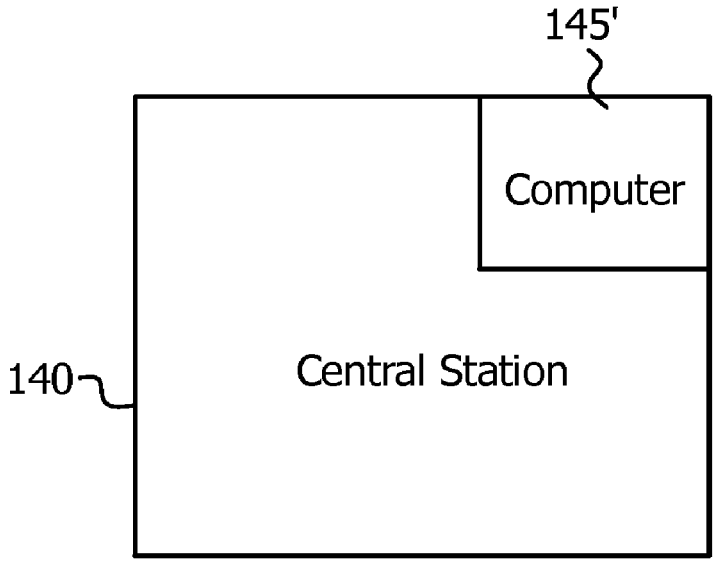

FIG. 1 is a schematic diagram of one embodiment of a central security monitoring and alarm system, which operates to notify hearing-challenged end-users in possession of the personal security device or pendant of the invention; and FIGS. 2*a* and 2*b* depict a computer that may be programmed to carry out the novel inventive operation when located at the protected premises, i.e., comprising a central panel, or a central monitoring location, i.e., comprising a control panel at the central station.

DETAILED DESCRIPTION OF THE PREFERRED EMBODIMENTS

As indicated hereinabove, it should be understood that the present invention could be realized in hardware, software, or a combination of hardware and software. Any kind of computer/server system(s)—or other apparatus adapted for carrying out the novel alarm verification methods described herein—is suited. A typical combination of hardware and software could be a general-purpose computer system with a computer program that, when loaded and executed carries out the respective methods described herein. Alternatively, a specific use computer, containing specialized hardware for carrying out one or more of the functional tasks of the invention, could be utilized.

The present invention can also be embodied in a computer program product, which comprises all the respective features enabling the implementation of the methods described herein, for example, the exemplary methods depicted in figures herein, and which product—when loaded in a computer system—is able to carry out these and related methods. Computer program, software program, program, or software, in the present context mean any expression, in any language, code or notation, of a set of instructions intended to cause a system having an information processing capability to perform a particular function either directly or after either or both of the following: (a) conversion to another language, code or notation; and/or (b) reproduction in a different material form.

While it is apparent that the invention herein disclosed is well calculated to fulfill the objects stated above, it will be appreciated that numerous modifications and embodiments may be devised by those skilled in the art and it is intended that the appended claims cover all such modifications and embodiments as fall within the true spirit and scope of the present invention.

A first embodiment of a central security and alarm system ("central security system") 100 that includes the novel personal safety device or pendant 105 for communicating to hearing-challenged end-users at protected home or business premises 102 is shown in FIG. 1. Central security system 100 includes a central panel 110, connected to a landline phone 108 and a number of alarm event detection devices 120. The central panel is also arranged to communicate directly to a novel personal safety device 105 of the invention. The communication to pendant 105 may be carried out by any known communications methods and means, such as by "Bluetooth." The personal safety device or pendant 105 vibrates at the receipt of a signal from the central panel, and further includes a panic button 106 that upon depression by an end-user, communicates a "panic" notice to the central panel.

The central panel 110 is typically in communication with a central monitoring station 150, where communications to/from the central panel, or directly from the end-user via the pendant or personal safety device are transmitted. When the central panel 110 receives notice of a detected alarm, it initiates an attempt to communicate directly to the hearing-challenged end-user. Upon receipt of the vibration or other non-aural communication signal via the personal alert device, the end-user responds by taking action. Action may take the form of vacating the protected premises, further investigation, communication to the central station, etc.

For that matter, FIG. 2*a* herein depicts a central panel 110 including a computer 145 for executing a set of computer readable program instructions that implement the novel communication method by which the pendant or personal safety device is used to communicate a detected alarm event directly from the home central panel to the hearing-challenged end-user, with non-aural signals. Alternatively, FIG. 2*b* shows a central station 140 including a computer 145' for executing a set of computer readable program instructions that implement the novel communication method by which the pendant or personal safety device is used to communicate directly from the central station to the hearing-challenged end-user at the occurrence of a detected alarm event.

The communications from either the central panel or the central station to the end-user's personal safety device may occur automatically upon detection of an alarm event or after some timed interval from the moment of detection in order that the system first process in an attempt to verify the exact nature of the alarm event.

And while it is apparent that the invention herein disclosed is well calculated to fulfill the objects stated above, it will be appreciated that numerous modifications and embodiments may be devised by those skilled in the art and it is intended that the appended claims cover all such modifications and embodiments as fall within the true spirit and scope of the present invention.

What is claimed is:

1. A method for monitoring a secured perimeter, border and/or building ("protected premises") and for communicating notice of detected alarm events at the protected premises to a hearing-challenged end-user using a life safety device, the method comprising steps of:

detecting an alarm event at the protected premises by an alarm event detection device;

notifying a designated, hearing-challenged end-user that the alarm event has been detected by causing the life safety device in the possession of the hearing challenged end-user to Communicate the detected alarm event by a mechanical communication signal; and sending a panic message from the life safety device of the hearing-challenged end-user to the alarm event detection device.

2. The method for monitoring as set forth in claim 1, wherein the step of detecting the alarm event includes that the alarm event detection device communicates the detection to a central monitoring panel at the protected premises, which controls the personal safety device to notify the hearing-challenged end user of said detected alarm event.

3. The method for monitoring as set forth in claim 2, wherein the step of notifying the designated, hearing-challenged end-user includes automatically causing the life safety device to vibrate upon receipt of a command from the central monitoring station.

4. The method for monitoring as set forth in claim 2, further including a step of communicating by the hearing-challenged end-user via the personal safety device to a central monitoring panel in response to the notifying.

5. The method for monitoring as set forth in claim 1, wherein the step of notifying includes using various sequences, sets or counts of relatively short vibrations to communicate particular alarm event occurrences.

6. The method as set forth in claim 5, wherein three short vibrations communicate to the hearing-challenged end-user that he/she should call a central monitoring station, and a constant vibration in excess of three (3) seconds indicates that the protected premises should be immediately vacated.

7. A central security and alarm system that operates to protect a home or business and includes a life safety device to physically communicate with a hearing-challenged end-user at the protected home or business, the system comprising:

at least one alarm event detection device located within the protected home or business;

a central panel in communication with the life safety device and the at least one alarm event detection device, the central panel comprising a processor for carrying out a method of communicating to the hearing-challenged end-user at the detection of an alarm event via the life safety device, where the method comprises the steps of:

detecting an alarm event by the at least one alarm event detection device;

notifying the designated, hearing-challenged End-user that the alarm event has occurred by causing the life safety device in the possession of the hearing challenged end-user to communicate the detected event by a mechanical communication signal; and sending a panic message from the life safety device of the hearing-challenged end-user to the alarm event detection device.

8. A computer program product disposed in a computer readable medium, the computer program product comprising:

a tangible storage medium readable by a processing circuit and storing instructions for execution by the processing circuit for performing a method for monitoring a secured perimeter, border and/or building ("protected premises") and for communicating notice of detected alarm events at the protected premises to a hearing-challenged end-user using a life safety device, the method comprising steps of:

detecting an alarm event at the protected premises;

notifying a designated, hearing-challenged end-user that the alarm event has been detected by causing the life safety device in the possession of the hearing challenged end-user to communicate the detected alarm event by a mechanical communication signal; and sending a panic message from the life safety device of the hearing-challenged end-user to the alarm event detection device.

* * * * *